United States Patent [19]

Bloomfield et al.

[11] Patent Number: 4,526,326

[45] Date of Patent: Jul. 2, 1985

[54] TRAVERSE ROLL FOR FILAMENT YARN CROSS WINDING APPARATUS

[75] Inventors: Allen A. Bloomfield, Aylesbury, England; James R. Goodall, Charlotte, N.C.

[73] Assignee: Imperial Chemical Industries Limited, London, England

[21] Appl. No.: 572,619

[22] Filed: Jan. 23, 1984

Related U.S. Application Data

[60] Division of Ser. No. 395,370, Jul. 6, 1982, abandoned, which is a continuation-in-part of Ser. No. 248,643, Mar. 27, 1981, Pat. No. 4,384,689.

[30] Foreign Application Priority Data

Apr. 2, 1980 [GB] United Kingdom ..... 8011073

[51] Int. Cl.[3] ..... B65H 54/34; B65H 54/48

[52] U.S. Cl. ..... 242/43.2; 242/18 EW

[58] Field of Search ..... 242/18 EW, 43.2, 43 R, 242/158.3, 158.5, 18 PW

[56] References Cited

U.S. PATENT DOCUMENTS

| | | | |
|---|---|---|---|
| 868,013 | 10/1907 | Rivett et al. | 242/43.2 |
| 892,783 | 7/1908 | Walder | 242/41 |
| 1,267,913 | 5/1918 | Seifert | 242/41 |
| 1,749,355 | 3/1930 | Reece | 242/43.2 |
| 1,928,365 | 9/1933 | Anderson | 242/43.2 |
| 2,212,775 | 8/1940 | Hamel | 242/43.2 |
| 2,221,999 | 11/1940 | Reiners et al. | 242/18 PW |
| 4,138,072 | 2/1979 | Aoyama et al. | 242/18 EW |
| 4,324,368 | 4/1982 | Inouye et al. | 242/18 EW X |
| 4,384,689 | 5/1983 | Bloomfield et al. | 242/18 EW X |

FOREIGN PATENT DOCUMENTS

| | | | |
|---|---|---|---|
| 296203 | 1/1917 | Fed. Rep. of Germany | 242/18EW |
| 537733 | 11/1931 | Fed. Rep. of Germany | 242/43.2 |
| 2312446 | 12/1976 | France | 242/18 EW |
| 384997 | 12/1932 | United Kingdom | 242/43.2 |
| 874651 | 8/1961 | United Kingdom | 242/43.2 |

*Primary Examiner*—Stanley N. Gilreath

*Attorney, Agent, or Firm*—S. M. Bodenheimer, Jr.

[57] ABSTRACT

The invention concerns an improved yarn package, process and apparatus. The improved package has particular utility in automated processes for making melt spun yarn. Broadly, the invention comprises (a) a cross wound package of melt spun flat filament yarn that is characterized by the yarn's outer end being pile wound in a compact bunch on the cross wound package's surface, the yarn end comprising at least twenty pile turns, the pile turns comprising upstream pile turns and downstream pile turns, and wherein the upstream pile turns partly underlap the downstream pile turns; and (b and c) modifications to conventional process and conventional apparatus for winding yarns, in order to make such packages, particularly at speeds greater than 3000 mpm.

3 Claims, 7 Drawing Figures

TRAVERSE ROLL FOR FILAMENT YARN CROSS WINDING APPARATUS

This application is a division of application Ser. No. 395,370, filed July 6, 1982, now abandoned, which in turn, is a continuation-in-part application of application Ser. No. 248,643, filed Mar. 27, 1981, now U.S. Pat. No. 4,384,689.

BACKGROUND

This invention relates to improved cross wound flat filament yarn packages and means for their production in melt spinning processes in which the improved package has a specific type of compact pile bunch wound thereon. More specifically, this invention is directed to an improved traverse roll which can be used to provide crosswound packages.

Cross wound packages of melt spun yarn are extremely old in the art. "Melt spinning" has been defined as "(t)he process in which the fiber-forming substance is melted and extruded into air or other gas, or into a suitable liquid, where it is cooled and solidified, as in the manufacture of polyester or nylon." (see "Man-Made Fiber and Textile Dictionary,", 1978, Celanese Corporation.)

Conventionally, these packages have been doffed, and the empty tubes donned, by operators. More recently, there has been an attempted trend to the use of semiautomated equipment in which machines rather than human operators perform the doffing/donning operations and subsequent handling of the packages.

The trailing yarn end on the outside of prior art melt spun cross wound packages is very prone to accidental unwinding. This is particularly so during doffing from a high speed winding machine in which the package is surface driven, because windage due to the driven rolls tends to unwind the trailing end as the package slows down and comes to rest. Trailing ends that unwind and entangle equipment pose problems particularly in the development of automated processes.

Cross wound packages having various types of pile windings thereon to prevent accidental unwinding by gravity during subsequent handling are known in the art. In particular, German Pat. No. 296,203 (published 1917) discloses a "plowed pile winding" and French Pat. No. 2,312,446 (published 1976) discloses a "radially compressed hand knitting yarn overlapped pile winding", as discussed below.

German Pat. No. 296,203 describes the production of a compacted pile wound bunch on the surface of a cross wound shuttle pirn in old fashioned slow speed embroidery equipment. Essentially, a pair of guides ("nose" and "horn") are pressed against the package during the pile winding. The nose prevents displacement of the thread as it runs onto the bobbin. The horn acts as a plow and lifts the windings already on the bobbin over the winding just applied. Thus the pile winding may be classified as a "plowed pile winding". Such a device would appear to be effective only with heavy denier yarns (such as embroidery yarns); and at tensions sufficiently low to permit the horn to dig under the windings; and at speeds sufficiently low to prevent the horn from damaging the yarn.

French Pat. No. 2,312,446 teaches process and apparatus

"which allows the making of balls the free end of the thread of which less easily runs the risk of unwinding.

The solution of this problem provided according to the present invention consists in that towards the end of the winding process the thread is guided in a fixed way with respect to the longitudinal direction of the winding cylinder between the positioning mechanism and the winding cylinder and in that, thanks to this guiding of the thread and in spite of the traversing movement of the positioning mechanism, the end of the thread is wound onto the ball essentially in a single plane extending transversely to the longitudinal direction of the winding cylinder.

This offers the advantage that the last turns of the thread on the ball are placed very close to one another and partly overlap so as to be protected to a large extent against the risk of unwinding.

It is an advantage within the framework of the process according to the invention that, after initiating the guiding of the thread according to the invention, the winding cylinder rotates more slowly than during the normal winding of the thread without the guiding envisaged according to the invention. Desirably the end of the thread is wound onto the central zone of the ball. In this way the end of the thread is always in a well determined plane which can be covered, for example, by a tape so that the end of the thread is always held securely by this latter."

"Ball" is defined elsewhere as "(t)he form of knitting yarn ready for use. It may be made of yarn from any of the major fibers, alone or in combination. The yarn is sold in so many ounce balls to the consumer." ("The Modern Textile Dictionary" by George E. Linton, published in 1957 by Duell, Sloan and Pierce). Likewise, "ball winding machine" is defined "(t)his machine winds yarn into small ball packages. Yarns for knitting, crocheting, tatting, etc., are wound this way." Accordingly, the term "ball" relates essentially to a small package of hand knitting yarn. Further, balls are normally made by a rewinding process in which the yarn on the ball is not "flat continuous filament yarn", but rather bulky yarns wound at tensions insufficient to remove the bulk.

All the thread shown in the figures of the French '446 patent is twisted and therefore typically compressible in cross-section. Accordingly, the pile winding may be classified as a "radially compressed hand knitting yarn overlapped pile winding".

Neither of the foregoing patents relates specifically to the following:

(1) a package of melt spun yarn;

(2) accidental non-gravity unwinding of the package, while it is still on the winder, as a package is rapidly stopped rotating from speeds of 3000 mpm under conditions of high air turbulence;

(3) accidental unwinding of the package when the axis of the package is essentially horizontal rather than vertical;

(4) packages of (2) in which the drive of the package also pulls the melt spun filaments away from the spinneret;

(5) packages which, when freshly wound, have a temperature greater than the ambient temperature;

(6) packages in which the yarn is untwisted interlaced continuous multifilament yarn;

(7) packages of flat melt spun yarn in which the upstream pile turns partly underlay the downstream pile turns;
(8) packages that are surface-driven by a separate drive roll;
(9) any definition of the minimum number of pile windings;
(10) any definition of the maximum unwinding tension;
(11) packages in which the denier and dye uptake of the resultant yarn are dependent upon winding conditions such as yarn tension and wind-up speed; and
(12) packages in which the pile turns are wound at controlled high tension of at least 0.5 g/dtex.

The trailing end of sewing thread sold for domestic use is typically held in a slot of the tube or spool flange. The compact side-by-side winding generally renders it quite impossible to embed the trailing end by hand between two adjacent windings. Likewise it is extremely difficult, if not impossible, to rewind sewing thread by hand in any type of wind, without tying a knot (such as a highwayman's hitch knot) that permits the trailing end to be secured.

Further, cross wound packages of melt spun flat filament yarn made by existing high speed melt spinning processes typically inherently have properties including the following:

1. yarn is interlaced continuous multifilament yarn;
2. package having been decellerated to rest from a surface speed of at least 3,000 mpm within 20 seconds and having an absence of broken filaments;
3. package having been cooled to ambient temperature after being wound;
4. package has a void space between the filaments of less than 40 percent by volume; often less than 35 percent and sometimes less than 30 percent;
5. yarn of the cross wound turns have essentially the same denier and dye uptake;
6. yarn having weight of less than 300 decitex;
7. yarn having zero real twist package may be saddle-shaped; and
8. yarn may be spun, partially oriented or fully drawn in a wide range of deniers and numbers of filaments.

Nowhere does the prior appear to disclose or suggest a cross wound package of melt spun flat filament yarn characterized by the yarn's outer end being pile wound in a compact bunch on the cross wound package's surface, the yarn end comprising at least twenty pile turns, the pile turns comprising upstream pile turns and downstream pile turns, and wherein the upstream pile turns partly underlap the downstream pile turns.

THE INVENTION

We have surprisingly found that the trailing end of a cross wound package of flat filament yarn can be rendered adequately resistant to accidental unwinding, and yet at the same time adequately responsive to deliberate unwinding, by winding the last few turns of yarn in a compact pile wound bunch at substantially zero helix angle on the cylindrical surface of the cross wound package. The stability of such a bunch can readily be assessed by holding a cross wound package with its axis horizontal and its trailing yarn end hanging free, and slowly rotating the package while pulling on the free end to unwind it so that it continues to hang from the underside of the package. A stage is reached when the freely-hanging end of yarn is heavy enough to unwind itself on rotation of the package without further need to pull it. Typically this starts to happen with less than 10 cm of yarn end freely hanging from a cross wound package surface, but when a compact bunch of at least 20 turns of yarn is pile wound at zero traverse angle on the cylindrical cross wound package surface the length of yarn end freely hanging from it which is needed to cause spontaneous unwinding on further rotation of the bobbin typically rises to over 100 cm, typically over 200 cm. The coherence, C, of the bunch may be defined conveniently as the minimum number of centimeters of freely hanging yarn which will cause such spontaneous unwinding. If the bunch has a coherency of less than 100 cm it provides insufficient resistance to accidental unwinding due to windage or other forces during doffing and subsequent handling. If the coherency of the bunch is too high then it will not unwind satisfactorily to feed yarn into a subsequent process, and then it must be stripped off before the bobbin is used as a practical yarn supply package. For this reason we prefer the unwinding tension, T, of the coherent bunch to be less than 0.5 g/dtex.

We prefer a compacted wound bunch of at least twenty turns and even more preferably at least fifty turns. If the tail is very long the coherency does not go on rising but the pressure due to the yarn tension or the drive roll or baling roll on the package surface during winding becomes sufficiently concentrated on the growing pile wound bunch to cause yarn damage during winding or tension snatching and filamentation during unwinding, or both. To avoid damage and retain adequate unwindability, we prefer less than 1000 turns and less than five hundred turns are even more preferable. We find one hundred to five hundred turns convenient to make but the shortest tail consistent with adequate coherence is the best.

During pile winding the yarn tension or the pressure of a surface drive or baling roll naturally causes some yarn displacement in which the upstream (later applied) pile turns partly underlap the downstream (earlier applied) pile turns: a pile wound tail of 130 decitex flat multifilament yarn typically becomes at least a millimeter wide when more than one hundred turns are wound. The yarn is therefore inevitably wound at small and randomly fluctuating angles to the circumference, around a mean angle of zero. This is acceptable; but if a residual true traverse helix angle of as much as one degree is permitted the coherency of the tail is reduced.

The centrifugal force on the yarn end, after cutting the yarn and before the package comes to rest, detaches it sufficiently from the rest of the pile wound bunch so that it can readily be found, but the coherence of a bunch according to the invention adequately suppresses accidental unwinding of the free end.

In order to make a bunch according to the invention the yarn traverse must be suppressed so that the yarn is allowed to pile wind for a short controlled interval before doffing. When the yarn traverse is caused by a single traverse mechanism such a reciprocating guide or a helically grooved roll, a tail according to the invention can be formed by lifting the yarn from the traverse means and engaging it in a fixed pile winding guide for a short controlled interval. The fixed pile winding guide is positioned conveniently close to, and between the extremes of, the traverse guide stroke in order to facilitate yarn transfer and so that the resultant pile wound yarn bunch is positioned between the ends of the cross wound yarn package. Any convenient mechanism may be used to effect this yarn transfer, one convenient mechanism comprising a yarn deflector guide movable along a line parallel with the winding spindle axis and profiled so that when it enters the triangle defined by the limits of the traverse stroke and the fixed feed guide, it lifts the yarn out of the traverse means near the limit of its stroke and deflects it into the fixed pile winding guide. Alternatives are to use a positively deflected instead of merely profiled deflector guide, or to move the pile winding guide itself into the yarn traversing triangle to intercept the yarn, or to transfer the yarn from the traverse means to the pile winding guide by a momentary pneumatic impulse.

After a controlled interval in the pile winding guide, the package may be doffed by any known procedure which may involve either cutting the advancing yarn and entraining it in an aspirator as for example described in U.K. Pat. No. 1,534,951, or transferring the advancing yarn directly from a full bobbin to an empty one as for example described in U.K. Pat. No. 1,294,752.

Apparatus embodiments of the invention which can be used to form the cross wound package of the invention include a traverse roll for a filament cross winding machine. The traverse roll has reversed helical traverse grooves in its surface and the reversed helical grooves cross each other. The traverse roll of the invention is additionally provided with a circumferentially oriented groove lying in a plane perpendicular to the axis of the roll. The circumferentially oriented groove intersects the helical traverse groove at at least one point and the helical groove is deeper than the circumferential groove. Advantageously, the circumferential groove can be provided so as to intersect the reversing traverse groove at a cross over point. In another advantageous embodiment, the circumferential groove has an arc length of between 20° and 200°.

When the yarn traverse is caused by a reciprocating traverse guide supplemented by a grooved traverse roll it is not enough to lift the yarn out of the traverse guide because the grooved roll often causes a significant degree of yarn flutter, sometimes traversing it between adjacent groove cross over points. We have discovered that traversing can be completely suppressed in such winders, so that a windage resistant pile wound bunch according to the invention can be produced, if a circumferential groove is provided in the traverse roll. This need not be cut round the whole circumference: an arc of even less than 180° can be sufficient. The pile winding guide must of course be positioned in the plane defined by the circumferential groove.

The circumferential groove has merely to be effective in preventing the yarn from being deflected by the helical traverse groove, and in keeping it in pile winding mode as it advances from a fixed guide on to the package surface. The conditions for achieving this depend on the circumstances. For instance if a high modulus yarn is being wound under low tension as it issues from a constant speed godet positioned close to the winder, then the circumferential pile winding yarn path length should not be significantly less than the helical traversing yarn path length, because the corresponding drop in yarn tension could easily be sufficient to cause enough yarn flutter to produce a bad bunch. A deep 360° groove would therefore not be preferred because there would be too much reduction in path length on going from helical to pile winding mode: but too shallow and short a groove could fail to be consistent enough in yarn entrainment even though it prevented loss of tension. Under such circumstances we prefer a circumferential groove with a depth slightly less than the helical groove depth and we also prefer that the circumferential groove is cut through a cross over point in the helical traverse groove. The symmetry of this arrangement and the avoidance of two separate groove intersections round the circumference improve consistency of operation. It is also helpful to provide a flattened nose between the crossing helical grooves to facilitate entry into the circumferential groove. We also prefer the groove to have an arc length substantially less than 360° so that the yarn tension is maintained in the pile wound mode by running the yarn over part of the traverse roll at its full diameter.

However, when, in an opposite extreme circumstance, a relatively low modulus melt spun yarn is being wound up without a godet from a distant spinneret, none of these considerations is nearly so critical because yarn tension is not so sensitive to the change in path length between helical and pile winding modes, and a wider range of groove designs is therefore acceptably workable.

In the accompanying drawings,

FIGS. 1 and 2 are plan views of parts of a grooved traverse roll of a multi-cop winder, each part including a full helical traverse groove and a circumferential groove according to the invention; and FIG. 3 is a semi-schematic plan view of a convenient mechanism for moving a yarn from a traverse guide to a fixed pile winding guide so that it leaves the helical traverse groove and engages in the circumferential groove.

FIG. 4 is an elevational view of prior art apparatus and yarn packages as shown in U.S. Pat. No. 4,138,072, including (i) apparatus for winding melt-spun yarn in the form of first full packages of crosswound yarn on tubes, each package having at least one bunch turn around the crosswound yarn and an end of yarn trailing from the bunch turn; (ii) separate apparatus for receiving the first package and rewinding the trailing end to form a second package; and (iii) second packages thereby obtained mounted on a package truck.

Figure 1:
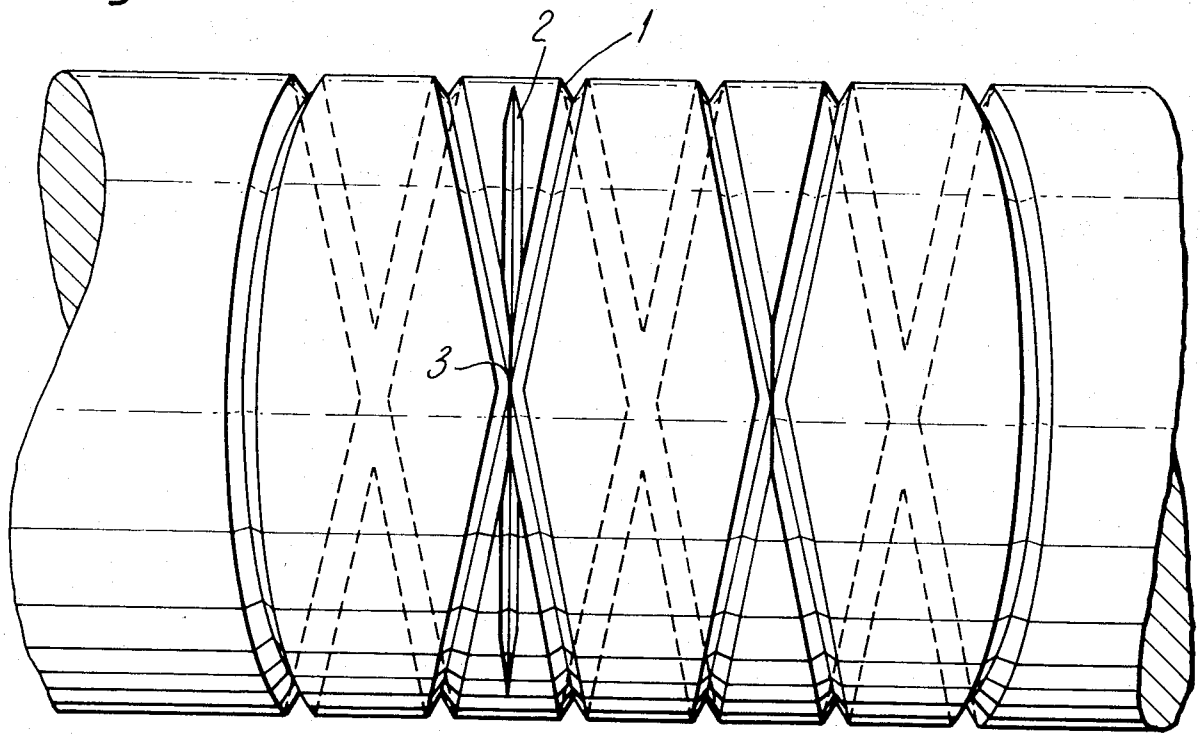

In FIG. 1 an arc of circumferential groove 2 extending about 170° round the traverse roll is cut to intersect a cross over point 3 in a helical traverse groove 1.

Figure 2:
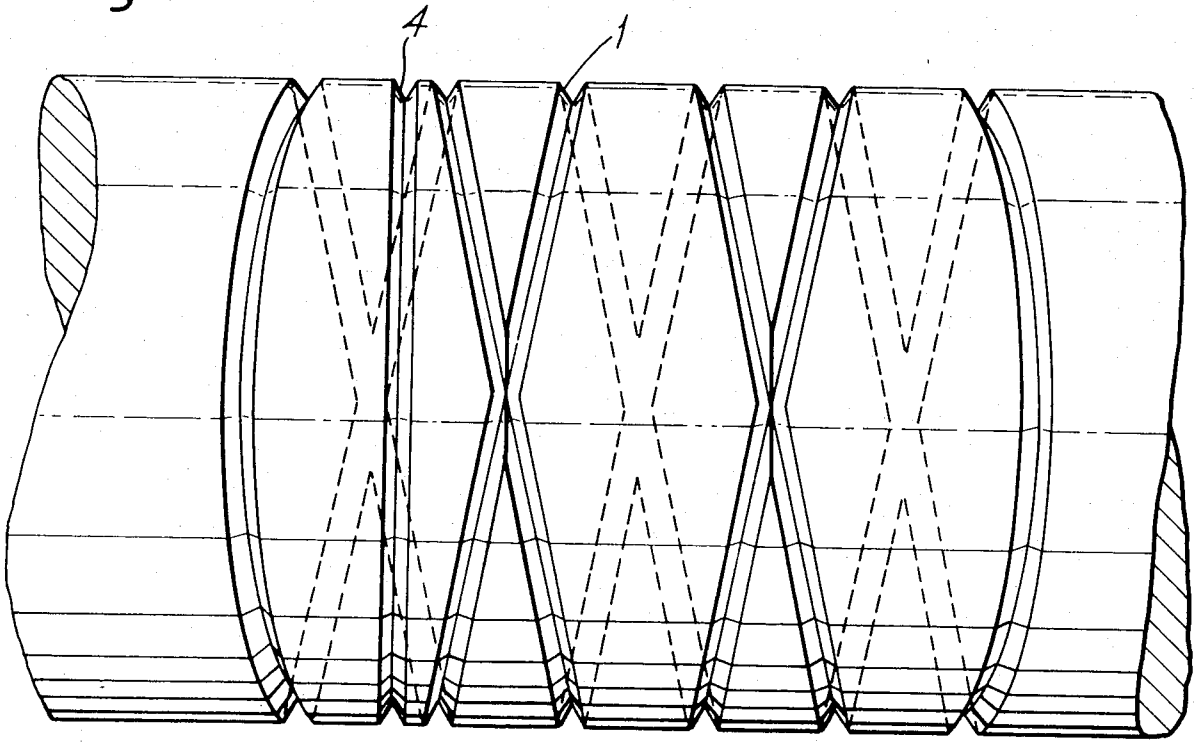

In FIG. 2 a full circumferential groove 4 is cut in a position not to intersect a cross over point in traverse groove 1.

The full circumferential groove 4 intersects the traverse groove twice, increasing the danger of yarn flutter causing re-entrainment into the traverse groove. The arc of circumferential groove 2 intersects the traverse groove only once, and the associated circumferential yarn path round the traverse roll at its full diameter does not intersect the traverse groove at all. This provides less opportunity for accidental re-entrainment in the traverse groove and maximum circumferential yarn path length and is therefore the preferred arrangement.

Figure 3:
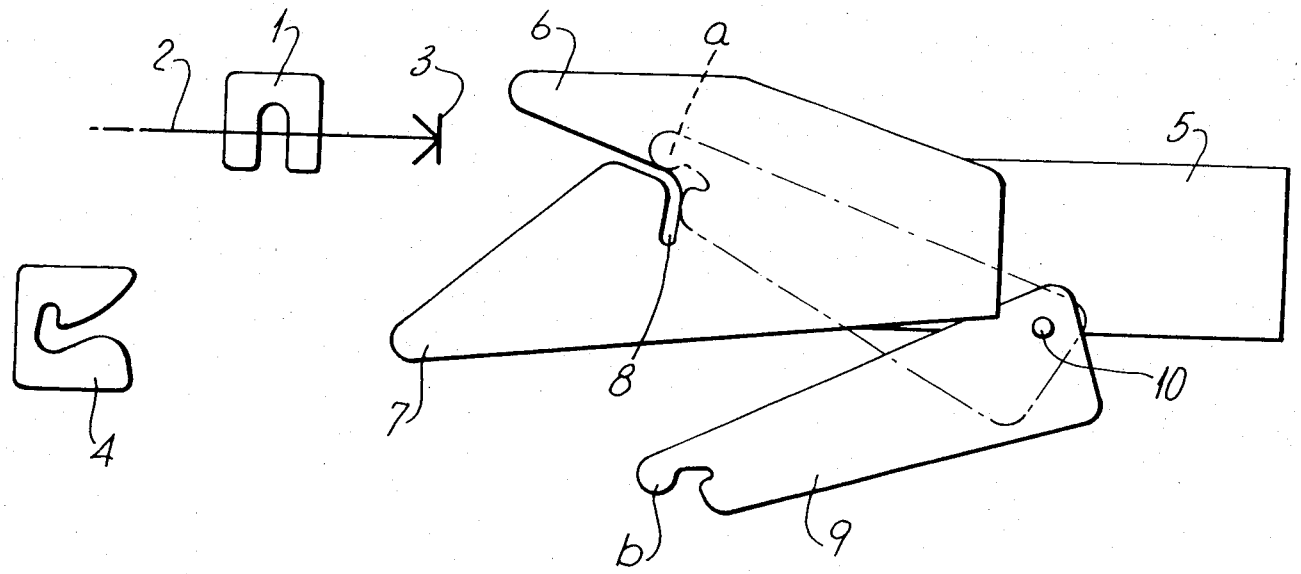
Figure 4:
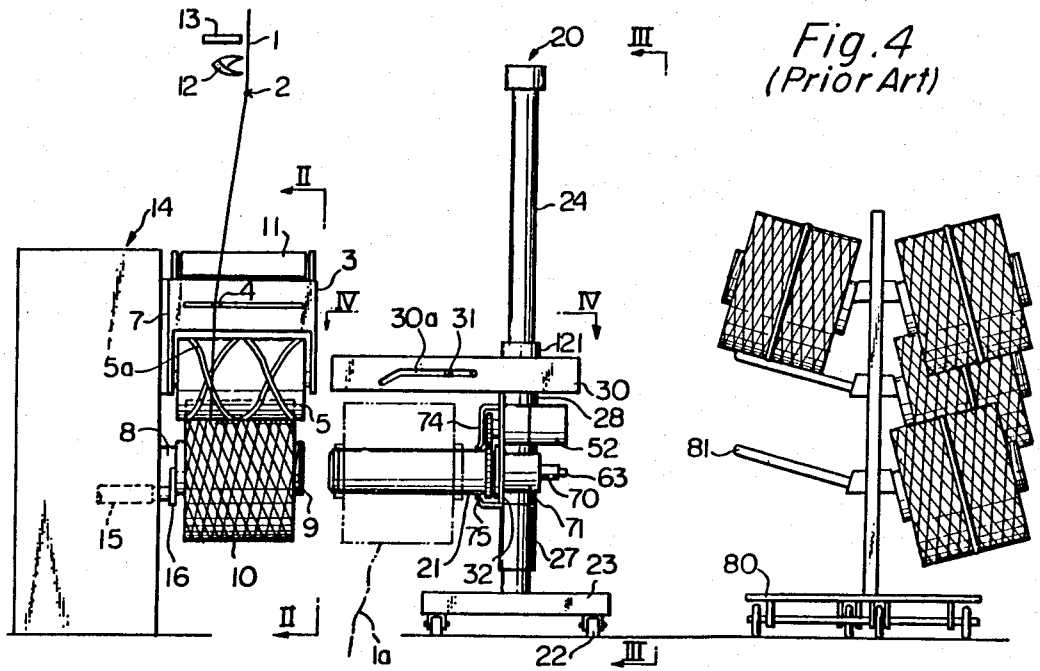
Fig. 4 (Prior Art)
Figure 6:
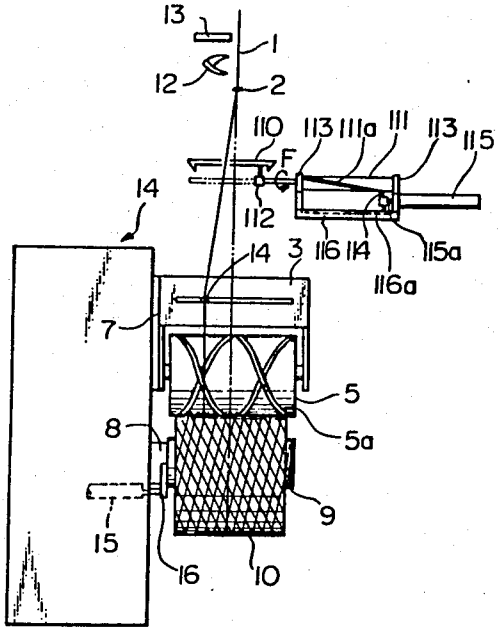
Fig. 6 (Prior Art)
FIG. 6 is an elevation view of a prior art yarn release guide mounted on doffing apparatus, for forming a bunch turn around a crosswound package.
Figure 5:
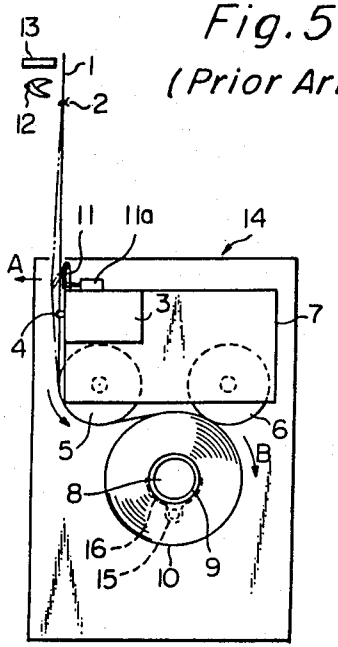
Fig. 5 (Prior Art)
FIG. 5 is a side view taken in the direction II—II of FIG. 4.
Figure 7:
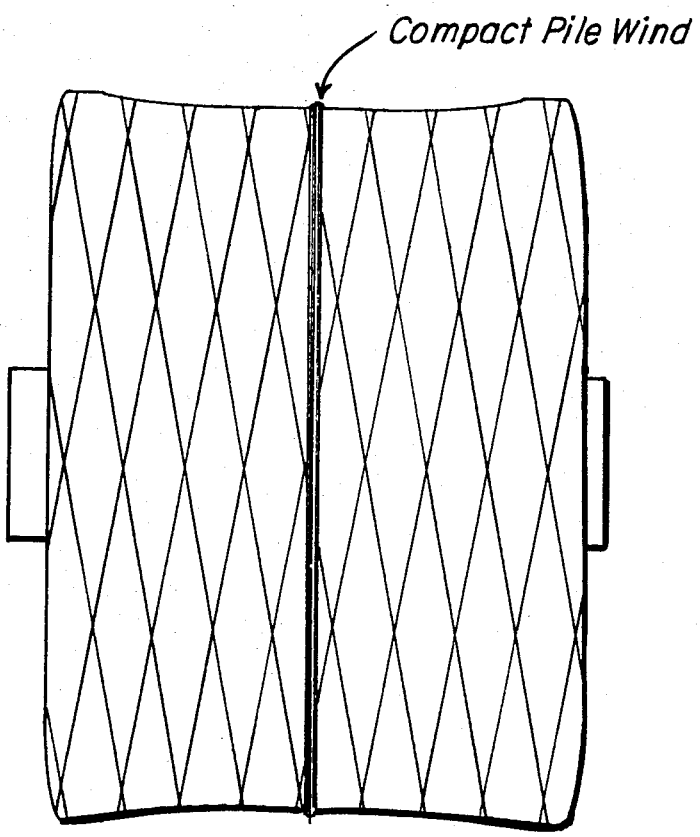
FIG. 7 is an elevation view of a package of the invention.

Turning to FIG. 3, a yarn traverse guide 1 has a stroke along line 2 with a right hand limit at point 3 and guide 4 is a fixed pile winding guide. A deflector guide 5 is moveable along a line parallel to line 2 but in front of it so that as it moves to the left collecting jaws 6 and 7, which are rigidly attached to it, embrace the path of a yarn which is advancing through traverse guide 1 in a plane substantially perpendicular to the drawing. As the deflector guide advances, the profile of jaw 6 lifts the yarn from the traverse guide 1 into the blind slot 8. A flipper 9 rotatably mounted on a pin 10 in member 5 is then moved by piston means not shown from position a to position b. As the deflector guide continues to advance to the left the yarn advancing through flipper 9 in position b engages in pile winding guide 4. The deflector guide 5 can conveniently be mounted on known yarn cutter and aspirator apparatus not shown. Control of the pile winding time is readily effected by using known sensors and timing devices not shown, providing for example a timed interval between the time when the deflector guide assembly reaches the position where the yarn is engaged in guide 4 and the time when the yarn cutter is actuated.

A Barmag SW46SSD winding machine with a helical traverse groove depth varying from 4 to 5 mm between traverse center and traverse end was modified with extra circumferential grooves of different kinds. The consistency of successful production of a tail according to the invention by each kind of added groove is indicated in general qualitative terms in the table in two different process circumstances.

| Circumferential Groove | Drawn 50 dtex flat interlaced polyester yarn received from a godet at 3650 mpm | Partially drawn 131 dtex flat interlaced polyester yarn received direct from a spinneret at 3000 mpm |
|---|---|---|
| 1. 3 mm groove away from cross over | Very inconsistent | Not entirely consistent |
| 2. 3 mm groove at cross over | Not consistent | Consistent |
| 3. 0.75 mm groove away from cross over | Not consistent | Not entirely consistent |
| 4. 0.75 mm groove at cross over | Consistent | Consistent |
| 5. 0.25 mm groove at cross over | Very inconsistent | Very inconsistent |
| 6. 1 mm groove at cross over | Consistent | Consistent |
| 7. 60° arc of 2 mm groove falling to zero at | Consistent | Consistent |

-continued

| Circumferential Groove | Drawn 50 dtex flat interlaced polyester yarn received from a godet at 3650 mpm | Partially drawn 131 dtex flat interlaced polyester yarn received direct from a spinneret at 3000 mpm |
|---|---|---|
| groove ends and rising to 3 mm at the groove center, which intersects the traverse groove at a cross over | | |

These experimental comparisons with two kinds of yarn and feed arrangement and one type of winder illustrate the selection of appropriate circumferential groove geometry. Different machine and process details will lead to different optima of circumferential groove design; and detailed optimization of the geometry of the leading or yarn entry end of the circumferential grove where it opens into or crosses the helical groove will improve consistency of operation in otherwise marginal cases. Optimum groove designs may also depend on other differences between kinds of flat yarns; whether for instance the filaments are more parallel as in non-interlaced yarns, or less parallel as in textured yarns held taught under the winding tension.

In one practical use of the invention, winding 50 dtex flat interlaced polyester yarns at 3670 mpm on Barmag SW46SSD machines modified with full circumferential grooves in the traverse rolls which were 1.8 mm deep and ceramic coated and intersected the traverse grooves at the central cross over points, bobbins were produced which all survived the doffing cycle on the winder without any problem from flying yarn ends, and which all unwound satisfactory on a beam creel. On these bobbins the yarn bunches according to the invention were characterized by unwinding tensions all below 0.1 gram/dtex and coherencies between 2 and 13 meters.

What we claim is:

1. A traverse roll for a filament yarn cross winding machine, said roll having reversed helical traverse groves in its surface, the reversed helical groves crossing each other, characterized in that the roll is provided with a circumferentially oriented groove lying in a plane perpendicular to the axis of the roll, such circumferentially oriented groove intersecting the helical traverse groove at at least one point and further characterized in that the helical groove is deeper than the circumferential groove.

2. A roll according to claim 1 in which the circumferential groove intersects the traverse groove at a cross over point.

3. A roll according to claim 1 in which the circumferential groove has an arc length between 20° and 200°.

* * * * *

UNITED STATES PATENT AND TRADEMARK OFFICE

CERTIFICATE OF CORRECTION

PATENT NO. : 4,526,326

DATED : July 2, 1985

INVENTOR(S) : Allen A. Bloomfield; James R. Goodall

It is certified that error appears in the above-identified patent and that said Letters Patent is hereby corrected as shown below:

Column 8, third line of Claim 1, "groves" appearing two times, should be corrected to read -- grooves --.

Signed and Sealed this

*Twenty-second* Day of *October 1985*

[SEAL]

*Attest:*

DONALD J. QUIGG

*Attesting Officer*

*Commissioner of Patents and Trademarks—Designate*